United States Patent [19]

Pelz

[11] 4,025,078

[45] May 24, 1977

[54] ATTACHMENT FOR A GOLF CLUB

[76] Inventor: David T. Pelz, 13129 Oriol Drive, Beltsville, Md. 20705

[22] Filed: May 23, 1975

[21] Appl. No.: 580,243

Related U.S. Application Data

[63] Continuation-in-part of Ser. No. 490,909, July 22, 1974, Pat. No. 3,912,277.

[52] U.S. Cl. ..... 273/186 A; 273/194 B; 273/171; 273/172

[51] Int. Cl.[2] ..... A63B 69/36; A63B 53/06

[58] Field of Search ..... 273/171, 172, 186 A, 273/186 C, 183 D, 194 R, 194 A, 194 B, 167 A, 167 J, 193 R, 175

[56] References Cited

UNITED STATES PATENTS

| | | | |
|---|---|---|---|
| 1,546,612 | 7/1925 | Barnes | 273/175 X |
| 2,057,821 | 10/1936 | Costello | 273/194 A |
| 3,021,141 | 2/1962 | Polsky et al. | 273/186 A |
| 3,194,564 | 7/1965 | Swan | 273/171 X |
| 3,912,277 | 10/1975 | Pelz | 273/186 A |

*Primary Examiner*—George J. Marlo
*Attorney, Agent, or Firm*—Nicholas J. Aquilino

[57] ABSTRACT

An attachment for a golf club designed to be used as a practice device whereby it is attached to a golf club in a practice mode and restricts the area on the striking face of the club where a ball may be properly struck by a pair of upstanding blades which extend across the club striking face equidistant from the effective center of percussion or sweet spot of the club.

4 Claims, 8 Drawing Figures

ATTACHMENT FOR A GOLF CLUB

RELATED APPLICATION

This application is a continuation-in-part of U.S. Application Ser. No. 490,909, for GOLF CLUB AND ATTACHMENT THEREFOR FOR USE IN PRACTICING AND PLAYING GOLF, filed July 22, 1974, by David T. Pelz, now U.S. Pat. No. 3,912,277.

BACKGROUND OF THE INVENTION

The present invention relates to a golf club attachment which provides a player with the opportunity to use a golf club as both a practice and playing device. More particularly, the invention is directed to an attachment adapted to be fit onto a putter to restrict the striking face on the putter for the purpose of teaching the player to strike a golf ball within the restricted area on the striking face.

Prior art golf practice devices designed for putting include the patents to Swan U.S. Pat. No. (3,194,564) and Polsky (3,021,141).

SUMMARY OF THE INVENTION

The present invention is an attachment for a golf club designed to be used as a practice device whereby, when it is attached to a golf club in a practice mode, restricts the area on the striking face of the club where a ball may be properly struck.

The device is designed to be reversed to a play-configuration of the golf club away from the striking face, or to be completely removed from the club head, when the club is being used to play golf.

The device is a unitary member having a pair of upstanding blades which extend across the club striking face equidistant from the effective center of percussion or sweet spot of the club striking face in such a manner that a ball being struck on one of said blades will deviate substantially from its intended line of travel.

Among the objects of the invention are the provision of a golf club attachment which may be used as a practice device to teach a player to strike a golf ball on the effective center of percussion of the club striking face, the provision of a practice attachment for a golf club which is simple in design and maintains the essential characteristics and nature of a conventional golf club, the provision of an attachment which may be used on a club in a first practice use position and a second playing use position thereby maintaining essentially the same characteristics in both use positions and the provision of a practice attachment which may be readily removed and a weight substituted therefor for use in a playing mode.

DESCRIPTION OF THE PREFERRED EMBODIMENT

Figure 1:
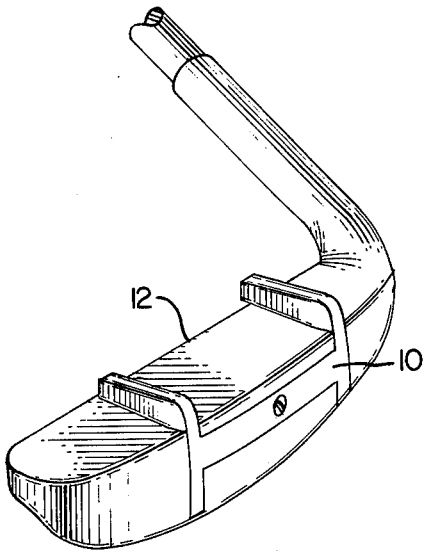
FIG. 1 is a perspective view of a golf club showing the attachment of the present invention in place in the practice mode.
Figure 2:
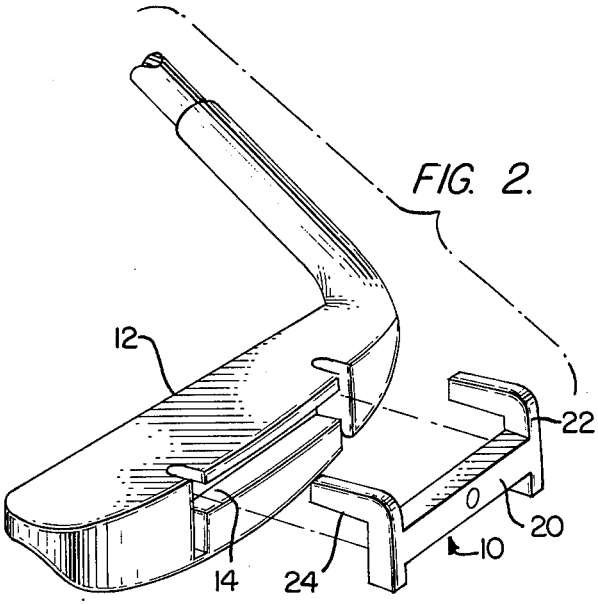
FIG. 2 is an exploded view of FIG. 1.
Figure 3:
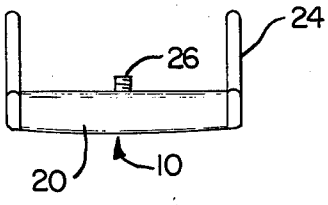
FIG. 3 is an elevation view of the attachment of the present invention.

An attachment 10 for a putter type golf club 12 is shown in FIGS. 1 and 2. The attachment is adapted to fit into an elongated H-shaped recess 14 integral with the bottom of the club head. The attachment is designed to be used in a playing mode or a practice mode depending upon the manner in which it is inserted into the cavity 14 of the club 12. For a detailed description of this arrangement and operation, reference is made to copending application Ser. No. 490,909 filed July 22, 1974 by David T. Pelz.

Figure 4:
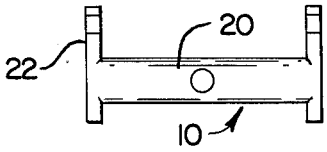
FIG. 4 is a top plan view of FIG. 3.
Figure 5:
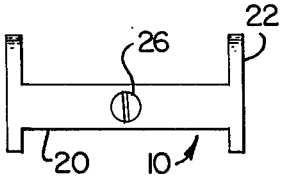
FIG. 5 is a bottom plan view of FIG. 3.
Figure 6:
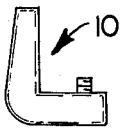
FIG. 6 is a side view of FIG. 3.

Referring to FIGS. 3 to 6, a preferred embodiment of the attachment of the present invention is shown having a central body portion 20. The attachment further includes an additional member 22 on each end perpendicular to the central body portion 20. One side of each of these members 22 is formed into a pair of upstanding blades 24 bent over to form an approximate angle of 90 degrees with the central body portion. The dimensions and shape of the attachment 10, as best seen in FIGS. 4 and 5, correspond to the elongated H-shape of the recess 14 in the golf club 12 and permit the attachment 10 to be inserted into the recess. The attachment 10 is designed to be fit into the recess 14 with the blades extending across the striking face of the club 12 as shown in FIG. 1 or because the attachment is symetrical, it may be inserted in the recess 14 so that the blades 24 project upwardly at the rear of the golf club 12 away from the striking face.

The physical characteristics of the attachment are not critical, and it may be any convenient shape or size as long as it can be readily mounted on and removed from the golf club. However, an important feature of the invention is that the mass of the attachment be essentially symetrical about its center in order that when it is positioned in the recess in the club, the attachment is symetrical with respect to the center of percussion or sweet spot of the club and reversal of the attachment does not alter the total weight, swing weight, sweet spot location, or swing characteristics of the club.

The attachment is secured by a screw 26 positioned in the center of the central body portion 20 of the attachment which engages a threaded bore in the golf club 12. However, any suitable fastening means may be used, by way of example, two or more screws or clamps. Furthermore, although the attachment is shown as being detachable from the putter head, it may be permanently mounted on a spring biased post so it may be rotated without the necessity of completely detaching the attachment from the club head.

Although the attachment is shown as being rectangular in shape, it will be appreciated any convenient design will operate equally as well. For example, the blades may be rounded or the blades may extend downwardly where the attachment is mounted on the top of the club rather than at the bottom.

Figure 7:
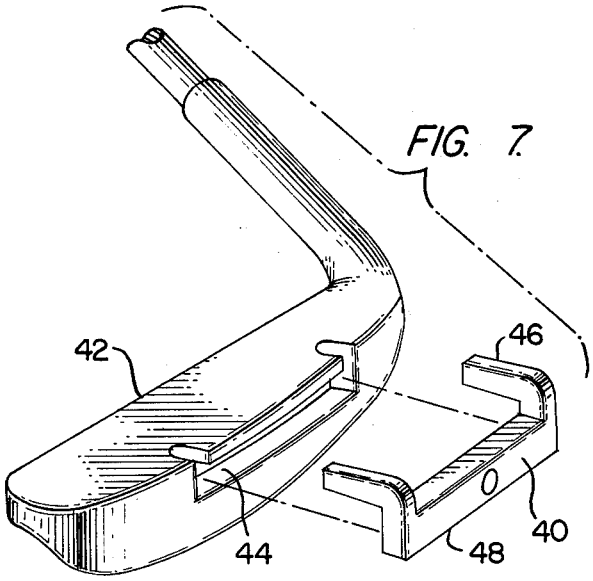
FIG. 7 is an exploded view showing an alternate embodiment of the attachment and its relationship to a club.

FIG. 7 shows an alternate embodiment of an attachment 40 of the present invention and a corresponding golf club head 42 having a recess 44 into which the attachment 40 fits. The attachment 40 is provided with a pair of blades 46 which project upwardly across the striking face of the club. The side 48 of the attachment 40 opposite the blades 46 is straight and presents a smooth regular surface which corresponds to the rear wall of the recess 44 in the club. With this arrangement, the attachment 40 is able to be used only in the practice mode, that is, with the blades 46 projecting across the striking face 48 of the club 42 since an attempt to reverse the attachment will not fit into the recess 44. With this arrangement, when the club is used in a normal playing mode, a weighted insert, not shown, the dimensions of which correspond to the recess 44, may be placed within the recess 44 to generally fill the recess opening when it is in place. This weighted insert would normally be essentially the same shape (except for the upstanding blades portion), size and weight as the attachment 40 and be interchangeable therewith so the club will retain the same essential characteristics as to weight, mass and feel in the playing mode with weighted insert in place in the recess 44 as in the practice mode with the attachment 40 in place in the recess.

Figure 8:
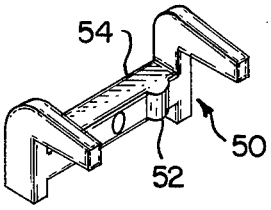
FIG. 8 is a perspective view of an embodiment of the attachment.

Another embodiment of the attachment 50 is shown in FIG. 8 which includes a raised projection 52 positioned on the attachment body 54 which would normally contact the bottom of a recess in a club to be used with the attachment. The projection 52 is designed to mate with a corresponding smaller recess in the larger recess so that the attachment will fit properly in only one position and it may not be reversed. A second attachment or weight with a raised projection on the opposite side could then be used during the playing mode. It will be appreciated any combination of projections and recesses, whether on the attachment or within the larger recess in the golf club, as well as any combination pins, holes or the like will achieve the desired result of making the attachments mountable in a single position on the club.

Inasmuch as the present invention is subject to many variations, modifications and changes in detail, it is intended that all subject matter described above or shown in the accompanying drawings be interpreted as illustrative and not in a limited sense.

What is claimed is:

1. A unitary attachment for use with a golf club head having a ball striking face with an effective center of percussion on said face and recess means on said golf club head for receiving said attachment integrally with said club head, said attachment having a predetermined mass including an elongated bar-like body portion of a generally rectangular configuration and spaced elements attached to opposite ends of said body portion and being perpendicular thereto, said spaced elements being generally L-shaped, each having a horizontal leg and a vertical leg, said horizontal leg being attached to said body portion and said vertical leg extending beyond said body portion and generally at right angles to said body portion, and projecting outwardly from said body portion and forwardly of said ball striking face when mounted on said club head receiving means to thereby form a restricted practice target area on said ball striking face and coupling means for securing said attachment to said club head receiving means.

2. The attachment of claim 1 wherein said body portion is adapted to fit in said receiving means forming a substantially uninterrupted club head surface.

3. The attachment of claim 1 wherein said spaced elements project equidistant from and on opposite sides of said effective center of percussion.

4. The attachment of claim 3 wherein said coupling means includes a screw-threaded fastener means engageable with said club head receiving means at the axis of the center of percussion for releasably securing the attachment to said golf club head.

* * * * *